US009849499B2

(12) United States Patent
Marti et al.

(10) Patent No.: US 9,849,499 B2
(45) Date of Patent: Dec. 26, 2017

(54) DEVICE AND METHOD FOR TRANSFERRING WORKPIECES INTO AND OUT OF A TOOL

(71) Applicant: Feintool International Holding AG, Lyss (CH)

(72) Inventors: Andreas Marti, Jegenstorf (CH); Patrick Hofer, Lyss (CH)

(73) Assignee: FEINTOOL INTERNATIONAL HOLDING AG, Lyss (CH)

( * ) Notice: Subject to any disclaimer, the term of this patent is extended or adjusted under 35 U.S.C. 154(b) by 423 days.

(21) Appl. No.: 14/467,427

(22) Filed: Aug. 25, 2014

(65) Prior Publication Data

US 2015/0053059 A1 Feb. 26, 2015

(30) Foreign Application Priority Data

Aug. 26, 2013 (EP) ..... 13004193

(51) Int. Cl.

| | |
|---|---|
| ***B21D 45/00*** | (2006.01) |
| ***B21D 43/05*** | (2006.01) |
| ***B21D 28/00*** | (2006.01) |
| ***B21D 43/14*** | (2006.01) |

(52) U.S. Cl.

CPC ..... *B21D 45/003* (2013.01); *B21D 28/00* (2013.01); *B21D 43/05* (2013.01); *B21D 43/14* (2013.01); *Y10T 83/06* (2015.04); *Y10T 83/6484* (2015.04)

(58) Field of Classification Search

CPC ..... B21D 28/12; B21D 28/125; B21D 28/14; B21D 28/16; B21D 28/26; B21D 28/34; B21D 28/36; B21D 43/028; B21D 43/04; B21D 43/05; B21D 43/14; B21D 45/003; B21D 45/02; B21D 45/04; B21D 45/06; B21D 45/10

See application file for complete search history.

(56) References Cited

U.S. PATENT DOCUMENTS

| | | | | |
|---|---|---|---|---|
| 3,831,426 | A * | 8/1974 | Hakner | B21D 43/05 72/405.03 |
| 2009/0090157 | A1 | 4/2009 | Schlatter | |
| 2012/0097001 | A1 | 4/2012 | Walther et al. | |

FOREIGN PATENT DOCUMENTS

| | | |
|---|---|---|
| EP | 2036629 | 6/2010 |
| EP | 2444172 | 4/2012 |

* cited by examiner

*Primary Examiner* — R. K. Arundale
*Assistant Examiner* — Pradeep C Battula
(74) *Attorney, Agent, or Firm* — Norris McLaughlin & Marcus, P.A.

(57) ABSTRACT

A rotary slide moves blanks cyclically from stage to stage of a cutting and processing tool. Work pieces are transferred in and out of the tool, without moving the slide in and out of the tool. The slide has a plurality of transfer openings and a discharge opening. Individual processing stages, including a discharge stage, are designed as separate components that support one another. The stages are arranged about a rotating axis of the slide. The transfer openings and the discharge opening lie in a circular path that coincides with circular paths of active elements of the cutting stage, the processing stages and the discharge stage. The openings have a distance from one another that is identical to the distance of the active elements in the circular paths.

16 Claims, 11 Drawing Sheets

DEVICE AND METHOD FOR TRANSFERRING WORKPIECES INTO AND OUT OF A TOOL

BACKGROUND OF THE INVENTION

The invention relates to a method and device for transferring work pieces into and out of a tool, in particular a multi-staged cutting and processing tool, wherein a blank is cut out of a clamped flat strip in an upper part.

A method and device are known from EP2 036 629 B1 for fine blanking and forming of a work piece made from a flat strip, wherein a plurality of processing stages lie in a circular path. The work pieces are transferred from one processing stage to the next by way of a rotatable cutting plate. This results in the cutting plate having both a cutting function and a transport function, which leads on one hand to a complicated design of the fine blanking tool and on the other hand encourages wear in the cutting plate due to the continuous sequence of aligning and locating in order to cut the work pieces and the rotational movement to transport the work pieces. Therefore, continuous monitoring of the active elements is required to maintain the precision and accuracy of the fine-blanked parts.

There is also a device known from EP 2 444 172 A1 for removing precision-punched or fine-blanked parts from a tool. The device makes use of a linearly movable cross slide to transport the work piece, the cross slide being movable into the work space between the working parts when the tool is opened, and out of the tool when it is closed. For multi-staged tools, this means that each work operation can only be carried out after the cross slide is moved out of the tool. The time it takes to open the tool must be accounted for, increasing the finishing time per part and decreasing productivity. Also, the linear slides require sufficient space and therefore make compact tool design difficult.

SUMMARY OF THE INVENTION

An object of the invention is to provide a device and a method for transferring work pieces in and out of multi-staged cutting and processing tools that eliminates the need to move the slide into and out of the tool while at the same time increasing the number of strokes and economic efficiency, degree of precision in the parts, improved compactness in the tool, and a simplified design.

Of significance is that the slide is designed as a rotary slide including a plurality of transfer openings and a discharge opening. Also, the cutting stage and the individual processing stages are designed with a discharge stage as separate, mutually-supporting components arranged about a rotating axis of the rotary slide, the axis being supported at the lower block. The transfer openings and the discharge opening lie in a circular path that coincides with the circular paths of the active elements of the cutting stage, the processing stages and the discharge stage. The transfer openings have a distance from one another that is identical to the arc distance between the active elements in the circular paths.

This is achieved in that the rotary slide comprises a slide plate in which the transfer openings and the discharge opening are matched to the size and shape of the cutting and processing stages in order to accommodate the blanks. The slide plate is connected to a linear drive that is arranged approximately tangential to the lower pressure plate and the lower frames coaxial to the circular path. The drive executes a horizontal pivoting motion of the plate about a rotating axis fixed at the lower block of the lower part. The slide plate connection is such that the transfer openings located in the circular path and the discharge opening of the slide plate seize the blanks after the plate pivots in the direction of the cutting stage by an amount equal to the arc distance of the cutting stage and the processing stages in the circular path. These openings can then drop the blanks from the cutting stage into the subsequent processing stages after the slide plate pivots hack from the cutting stage.

According to a preferred embodiment of the device according to the invention, the slide plate can be clamped between the frames of the active elements of the processing stages of the upper and the lower parts upon closing in such a way that the active elements can process the blanks through the transfer openings. The slide plate thus becomes an integral part of the tool.

In another embodiment of the invention, the distance from the rotating axis of the slide plate to the far edge of the flat strip away from the slide plate is equal to the radius of the slide plate. This makes it possible to provide two mirror-imaged rotary slides in the travel direction of the flat strip opposite one another, having pivot directions opposite to one another for transferring the blanks and work pieces. The two rotary slides are disposed offset relative to one another in the direction of travel of the strip at a distance that is equal to about four times the arc distance of the cutting stage and the first processing stage in the circular path.

In another useful embodiment of the device according to the invention, the slide plate is disposed in a plane that allows horizontal pivoting of the slide plate with the transfer openings and the discharge opening directly over the respective active elements of the cutting stage and processing stages when the tool is open. In this way, the transfer openings and the discharge opening reach a position in which they can accommodate the blanks and grasp them for transport.

According to another embodiment of the invention, the slide plate is designed as a section of a circular disc provided with a dog at the periphery thereof facing the linear drive. The dog is connected to a carriage guided in a guide rail of the linear drive for purposes of executing the pivot motion of the slide plate about the rotating axis.

It is also an advantage that the slide plate comprises stop plates with stops at the frames of the active elements of the lower part for limiting the displacement of the linear drive to the arc distance between the fine blanking stage and the processing stages.

Another preferred embodiment of the device according to the invention provides that the transfer opening for the cutting stage is provided with claws for gripping the cut blank. The transfer openings for the processing stages are provided with transport masks for aligning and fixing the blanks. The opening fix discharging the finished work piece is provided with transport magnets for lifting and feeding to a chute.

According to another preferred embodiment of the device according to the invention, the discharge stage comprises an ejector fixed to the upper block of the upper part and located in the circular path. The ejector separates the finished work piece from the transport magnets of the discharge opening to a discharge chute.

In another preferred embodiment of the invention, the chute is disposed perpendicular to the circular path and parallel to the direction of travel of the strip. The chute is connected to at least one conveyor belt for removing the finished work pieces, the direction of removal of the conveyor belt being perpendicular to the chute.

The object is further achieved by transferring the blanks between the cutting stage and the processing stages when the tool is open using a reversible slide plate of a rotary slide. The plate includes transfer openings and a discharge opening. The rotary slide seizes the blank cut in the cutting stage by making a first pivot motion by an amount equal to the arc distance between the cutting stage and the processing stages and bringing it to the first processing stage in a second direction of identical arc distance opposite to the first pivot motion for processing. At the same time the blanks from the first processing stage and from the other processing stages are shifted to the next respective processing stage, and the finished work piece is discharged.

The method according to the invention proceeds substantially with the following steps:

a) holding the flat strip at the guide plate of the upper part when opening the tool, which is done by lowering the lower part;

b) pivoting the slide plate and the transfer openings and discharge opening thereof that lie in the circular path until the first transfer opening facing the cutting stage sits over the cutting stage, and the remaining transfer openings sit over the processing stages, and the discharge opening sits over the last processing stage, c) ejecting the blanks from the cutting stage and the processing stages to the respective transfer openings and ejecting the finished work piece into the discharge opening, d) pivoting the slide plate in a direction opposite to step b) with the blanks seized by the transfer openings until the slide plate releases the cutting stage, and the transfer openings with the blanks reach the next processing stages, e) aligning and centering the blanks in the processing stages and accommodating the finished work piece in the discharge opening, and f) clamping the slide plate between the frames of the active elements of the processing stages of the upper and lower parts simultaneously with the clamping of the strip material in the cutting stage when closing the upper and lower parts in the position reached according to step e), such that the active elements of the processing stages can process the blanks through the transfer openings, a new blank is cut in the cutting stage and the finished work piece is pushed out of the discharge opening by an ejector to a chute for removal.

One particular advantage is that the rotary slide is driven by a linear drive attached at the lower block and running tangentially coaxial to the circular path. The displacement of such linear drive matches the arc distance between the cutting and the processing stages in the circular path so that it is certain that the respective transfer and discharge opening always sits over or reaches the corresponding active elements, and so that the cutting stage is exposed for the next cutting process.

In another embodiment of the method according to the invention, rotary slides are used on both sides of the flat strip to transfer the cut and processed blanks. The pivot directions of the rotary slides are directed opposite to one another so that the entire width of the flat strip can be used for cutting.

In another preferred embodiment of the method according to the invention, the far side edges of the flat strip are guided over the periphery of the respective slide plate of the respective rotary slide, resulting in the rotary axes of the rotary slide being equal distances away from the flat strip, respectively.

Other advantages, features and details of the invention can be found in the following description with reference to the attached drawings.

BRIEF DESCRIPTION OF THE DRAWINGS

The invention is described in more detail below using an example of the manufacture of a fine-blanked part with internal cogging. It is understood that stamped or fine-blanked parts of other configurations are also covered by the invention.

Shown are.

DETAILED DESCRIPTION OF SPECIFIC EMBODIMENTS

Figure 1:
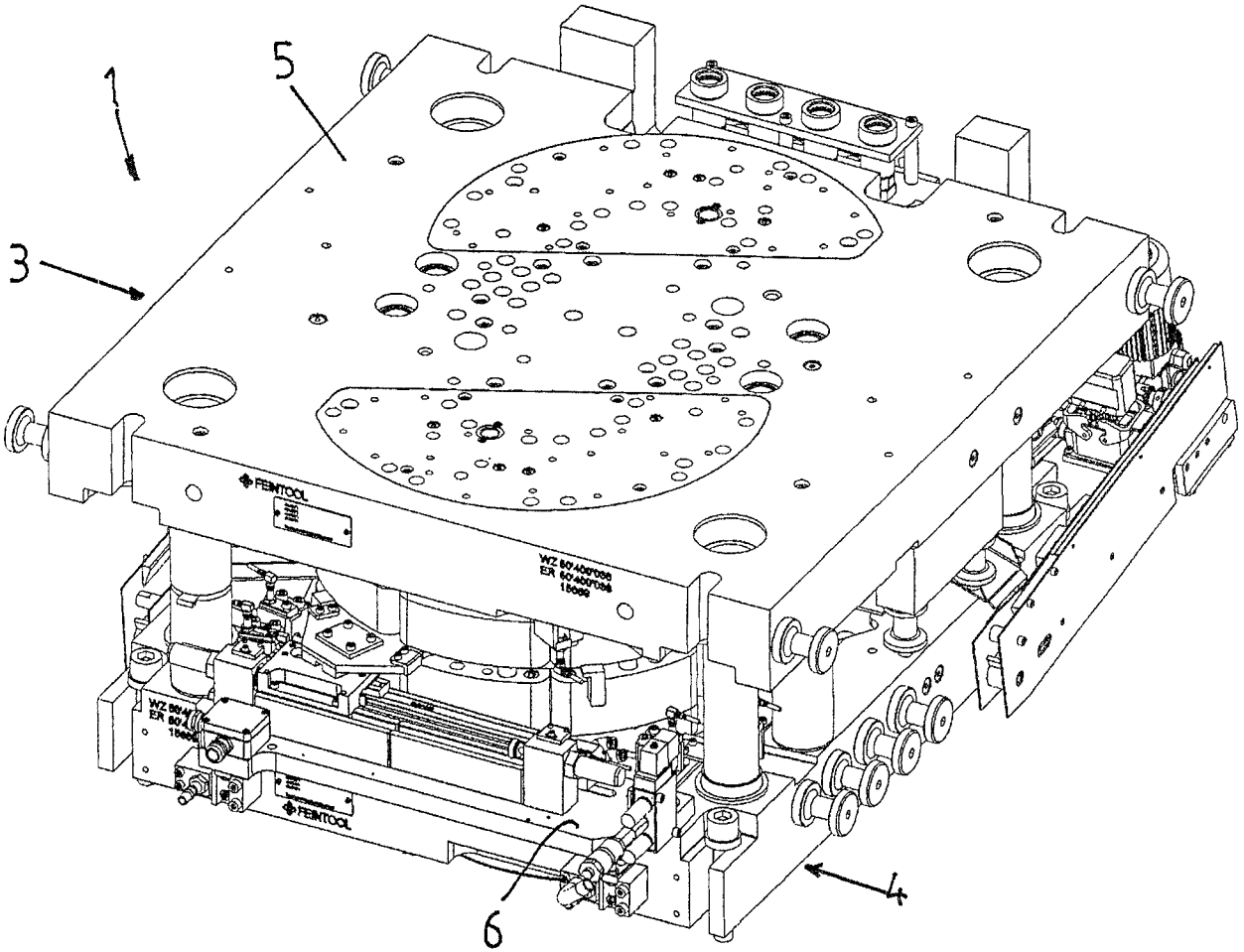
FIG. 1 is a perspective view of a cutting and processing tool made of an upper part and a lower part in the closed state.
Figure 11:
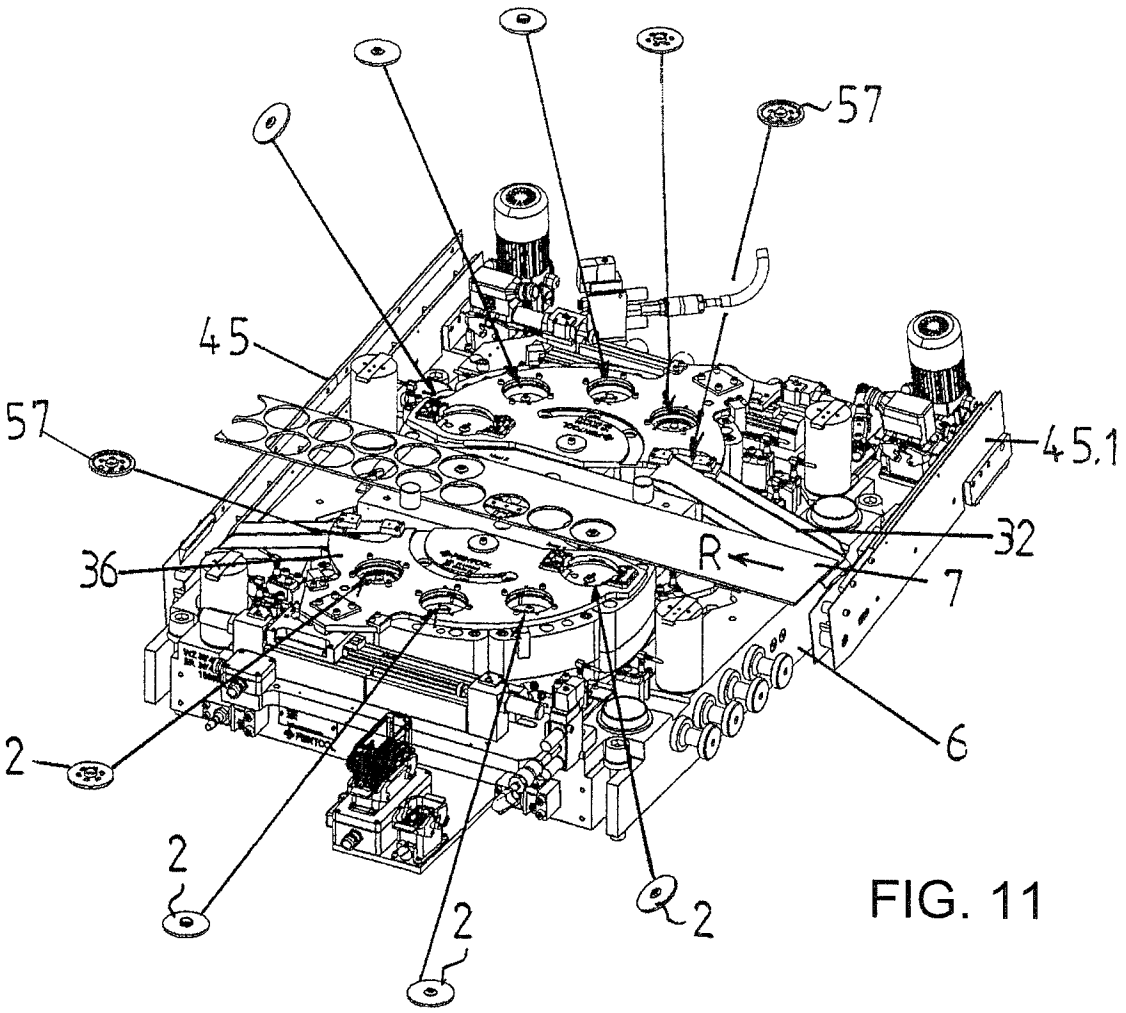
FIG. 11 is a perspective representation of the lower part with rotary slides pivoted back in the closed state of the tool, with the blanks and the finished work piece associated with the transfer openings and the discharge opening.

FIG. 1 shows a cutting and processing tool 1 for cutting a blank 2 and processing it into a finished work piece 57 (see FIG. 11). The cutting and processing tool 1 is made up essentially of an upper part 3 and a lower part 4. The upper part 3 is immovably fixed, by way of the upper block 5 thereof, to a machine table, which is not further shown, and is fixed by way of the lower block 6 thereof by a ram of a press, such that the blank 2 is cut out upward from a flat strip 7 from below, which is to say, toward the upper part, in the cutting stage 8 and 8.1.

Figure 2:
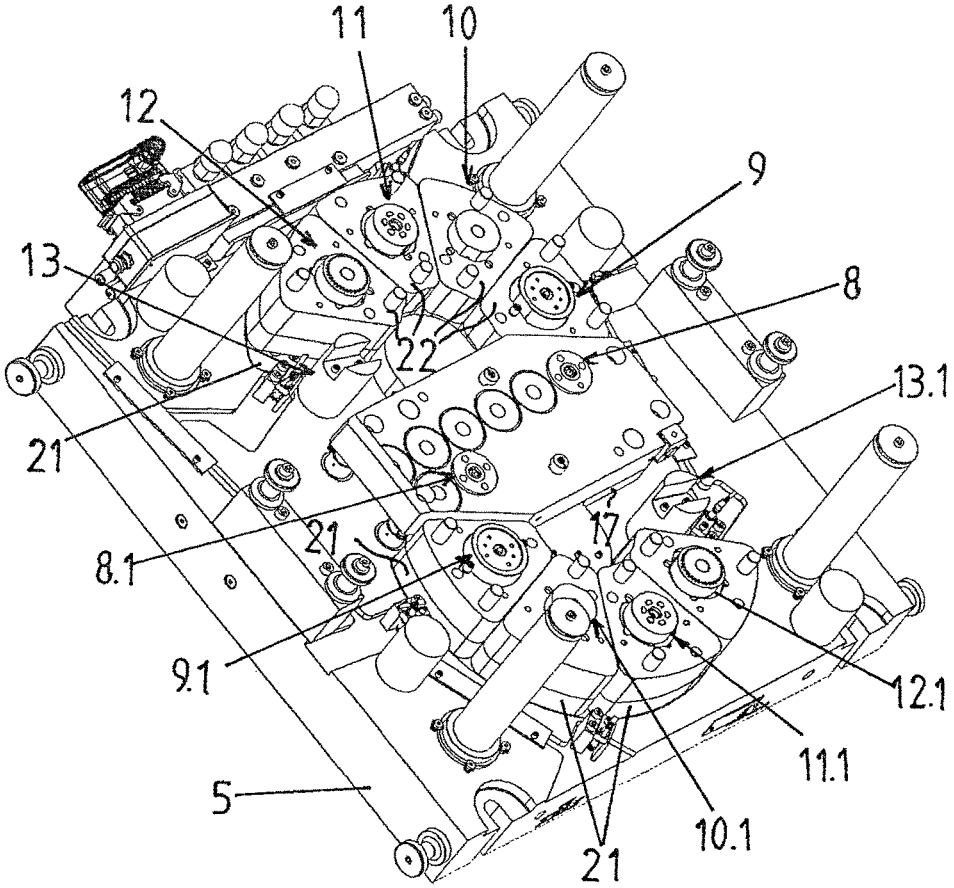
FIG. 2 is a perspective view of the bottom of the upper part of FIG. 1.
Figure 3:
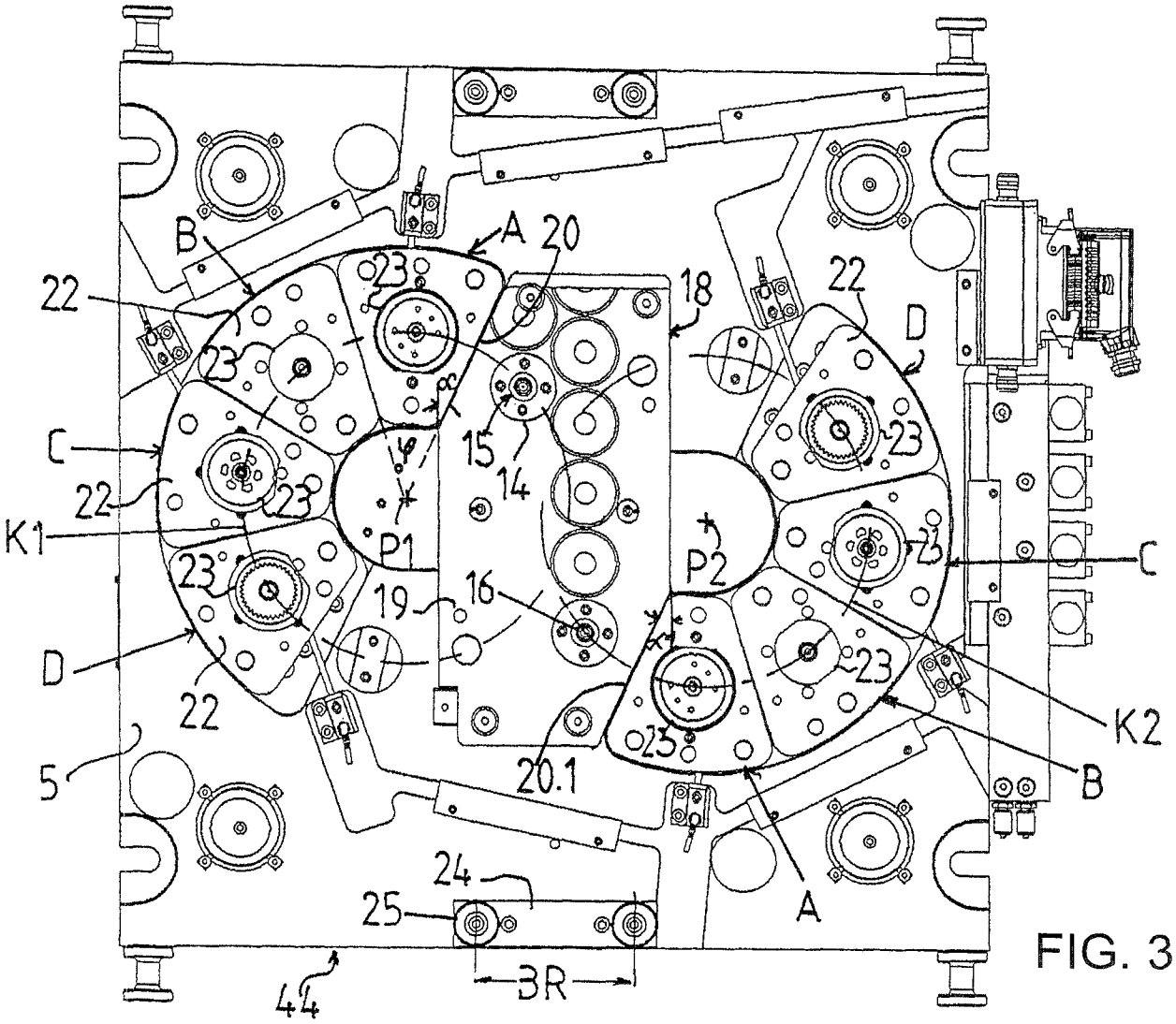
FIG. 3 is a direct view of the bottom of the upper part according to FIG. 2.

The cutting and processing tool 1 has two cutting stages 8 and 8.1 separated from one another in the direction of travel R of the strip and a plurality of processing stages 9 to 12 and 9.1 to 12.1 per cutting stage, respectively, as well as one discharge stage each 13 and 13.1. As shown in FIGS. 2 and 3, the upper active elements of the cutting stages 8 and 8.1, for example a cutting punch 14 with internal punch insert 15 and embossing die 16, are disposed in a guide plate 18 that sits atop a pressure plate 17. The guide plate 18 is designed as a longitudinal polyhedral member 19 with two chamfers 20 and 20.1 with which each of the cutting stages 8 and 8.1 is associated, respectively. The upper active elements of cutting stages 8 and 8.1 in the guide plate 18 lie in circular paths K1 and K2 superimposed over center points P1/P2, respectively. The upper parts of the processing stages 9 to 12 and 9.1 to 12.1 are located in the circular path as separate upper components A, B. C and D in the form of circular segments and an ejector 58. Components A through D each have separate pressure plates 21 and frames 22 in which the upper active elements 23 are held, for example an embossing bell, hole punch, ejector, setting, clamping and cogging punches.

The chamfer angle α at the guide plate 18 is matched with the central angle ϕ of the circular-segment components A, B, C and D such that it is equal to 0.5 times the mid-point angle ϕ. As a result component A sits directly against the chamfers 20 and 20.1 of the guide plate 18 next to cutting stages 8 and 8.1 in circular paths K1 and K2, respectively.

Figure 4:
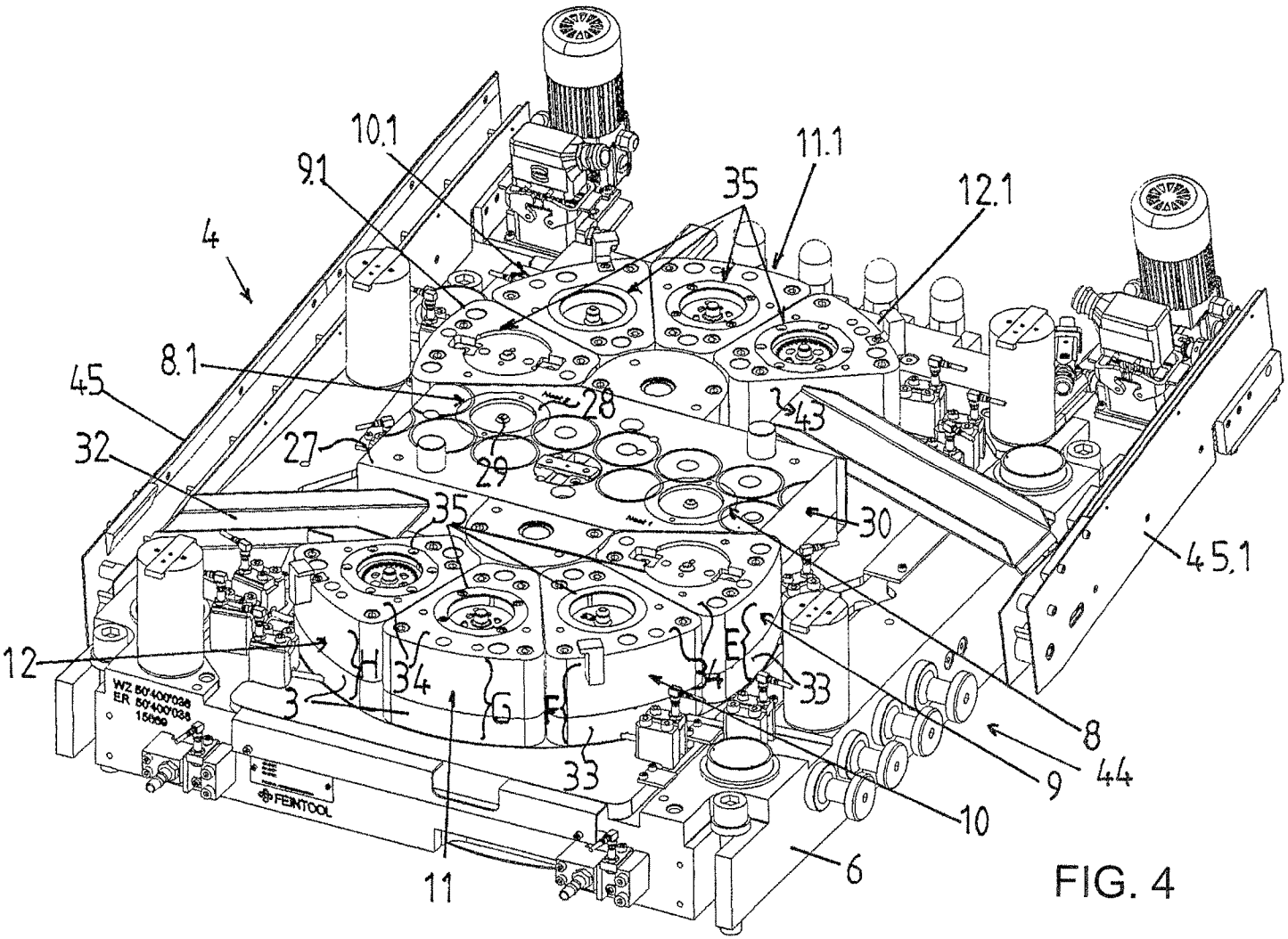
FIG. 4 is a perspective view of the lower part without flat strip and pusher slides in the closed state of the tool.
Figure 5:
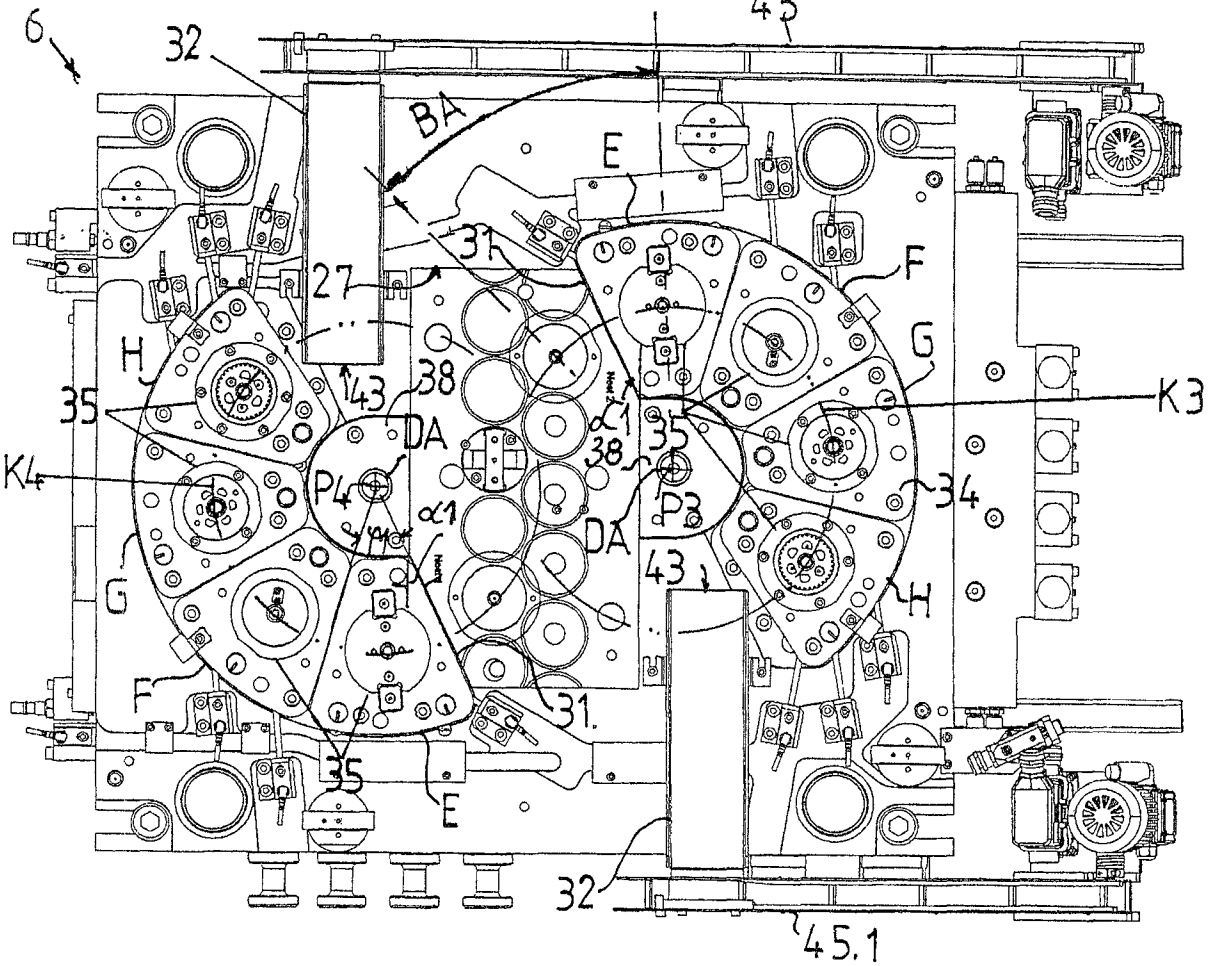
FIG. 5 is a direct view of the lower part in the open state of the tool according to FIG. 4.
Figure 6:
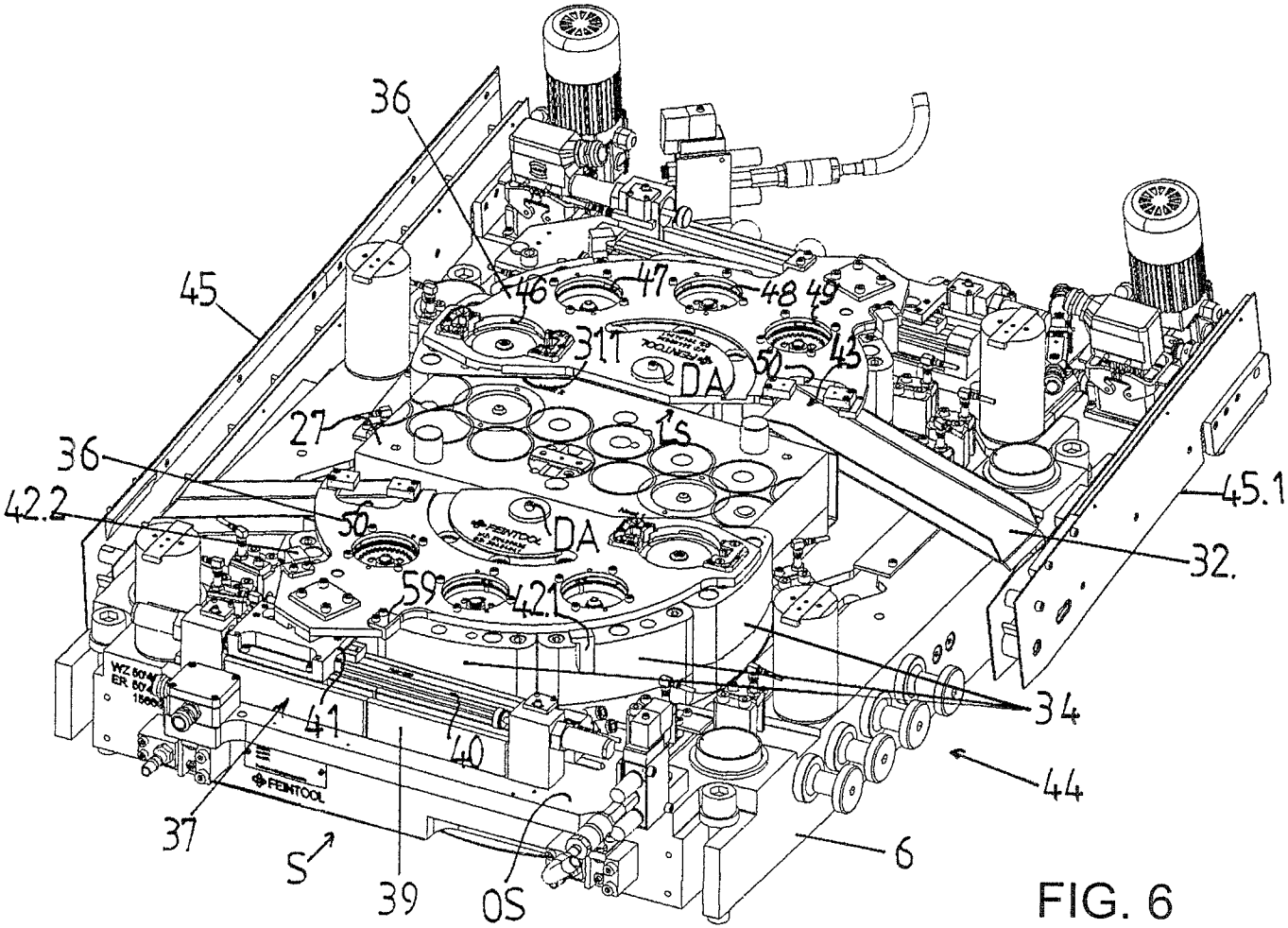
FIG. 6 is a perspective view of the lower part with rotary slides without flat strip in the closed state of the tool.
Figure 7:
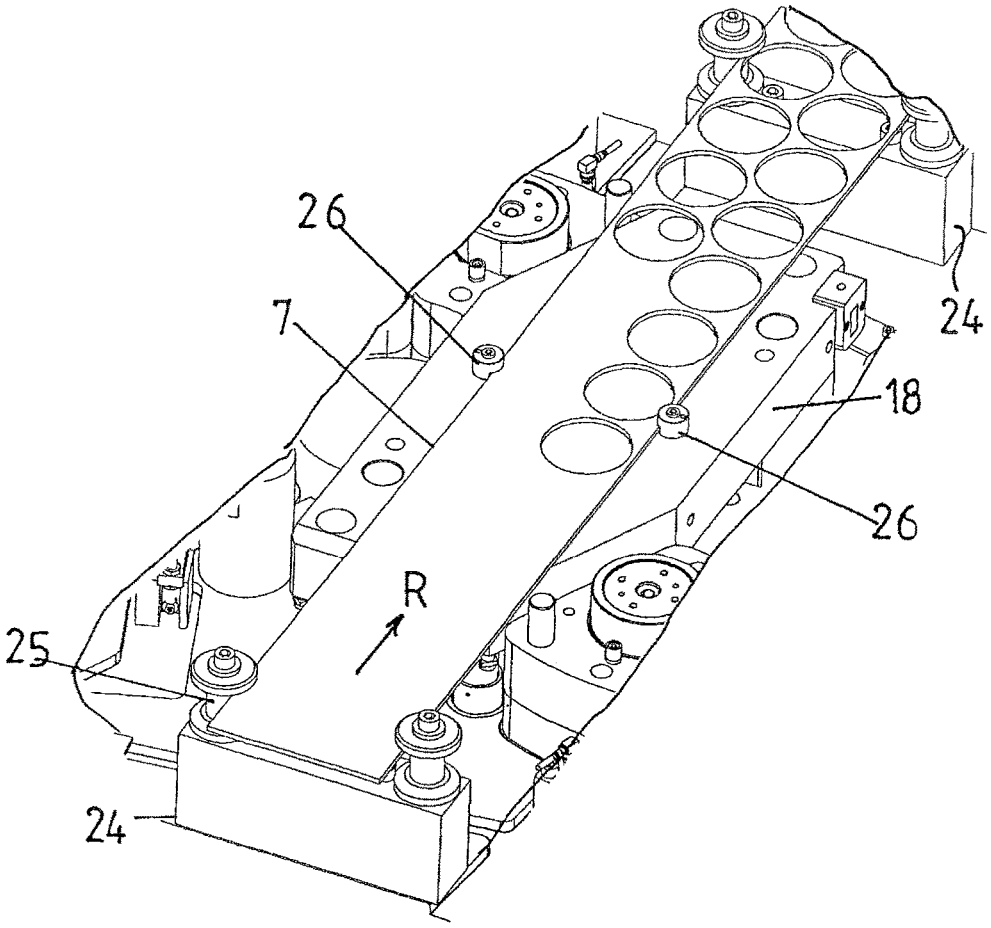
FIG. 7 is an enlarged view of the mounting of the flat strip on the upper part.

As shown in FIG. 2 in conjunction with FIG. 7, strip guides 24 are provided centered on each longitudinal side 44 of the upper block 5. Each of the guides consists of rolls 25 separated by a distance equal to the width BR of the flat strip 7. The guide plate 18 comprises strip holders 26. As soon as the lower part executes a lowering motion to open the tool, the flat strip 7 is held in position by the strip guides 24 and the strip holders 26 so that a sufficient amount of free space results below the flat strip 7 for corresponding transfer operations. Reference is made at this point to FIGS. 4 through 6. FIG. 4 represents the basic design of the lower part 4 in the closed state without the flat strip 7 and the rotary slide 37, which will be described below. The lower part 4 comprises a lower block 6 on which are arranged the lower parts of the cutting stages 8 and 8.1 such as the cutting plate 27, cutting plate inserts 28 and embossing dies 29, as well as the lower active elements 35 of the processing stages 9 to 12 and 9.1 to 12.1.

The cutting plate 27 is located in the center of the tool along with the guide plate 18 in the direction of travel R of the strip and has a longitudinal polyhedron-shaped member 30, which is the same identical shape and form as the guide plate 18, with two chamfers 31 and 31.1, with which each of the lower parts of the cutting stage 8 and 8.1 is associated, respectively. The lower parts of the cutting stages 8 and 8.1 lie in the cutting plate 27 in a circular path K3 and K4 superimposed about the center point P3/P4. The lower active elements of processing stages 9 to 12 and 9.1 to 12.1 lie in the circular path as separate lower components E, F, G and H in the form of circular segments, as does a chute 32 of discharge stages 13 and 13.1. Components E to H each comprise separate lower pressure plates 33 and lower frames 34 in which are accommodated the lower active elements 35, such as an anvil, cutting plate inserts, punches for drawing, calibrating and supporting, as well as ejectors.

The chamfer angle α1 on the cutting plate 18 is matched to the central angle ϕ1 of the circular-segment lower components E, F, G and H in such a way that it is 0.5 times the central angle ϕ1. This causes component E to come to sit directly against the chamfers 31 and 31.1, respectively, of the cutting plate 27 on the respective circular paths K3 and K4 along with the lower active elements of cutting stages 8 and 8.1, respectively (see FIG. 5).

A rotating axis DA of a slide plate 36 of a rotary slide 37 is positioned in perpendicular alignment with the center points P1/P2 of the lower circular paths K1/K2 and the center points P3/P4 of circular paths K3/K4—as shown in FIG. 6. The rotating axis DA is held by an attachment plate 38 supported on the lower block 6. The plate sits directly against the longitudinal sides LS of the cutting plate 27 above the chamfer 31 and 31.1, respectively.

Figure 10:
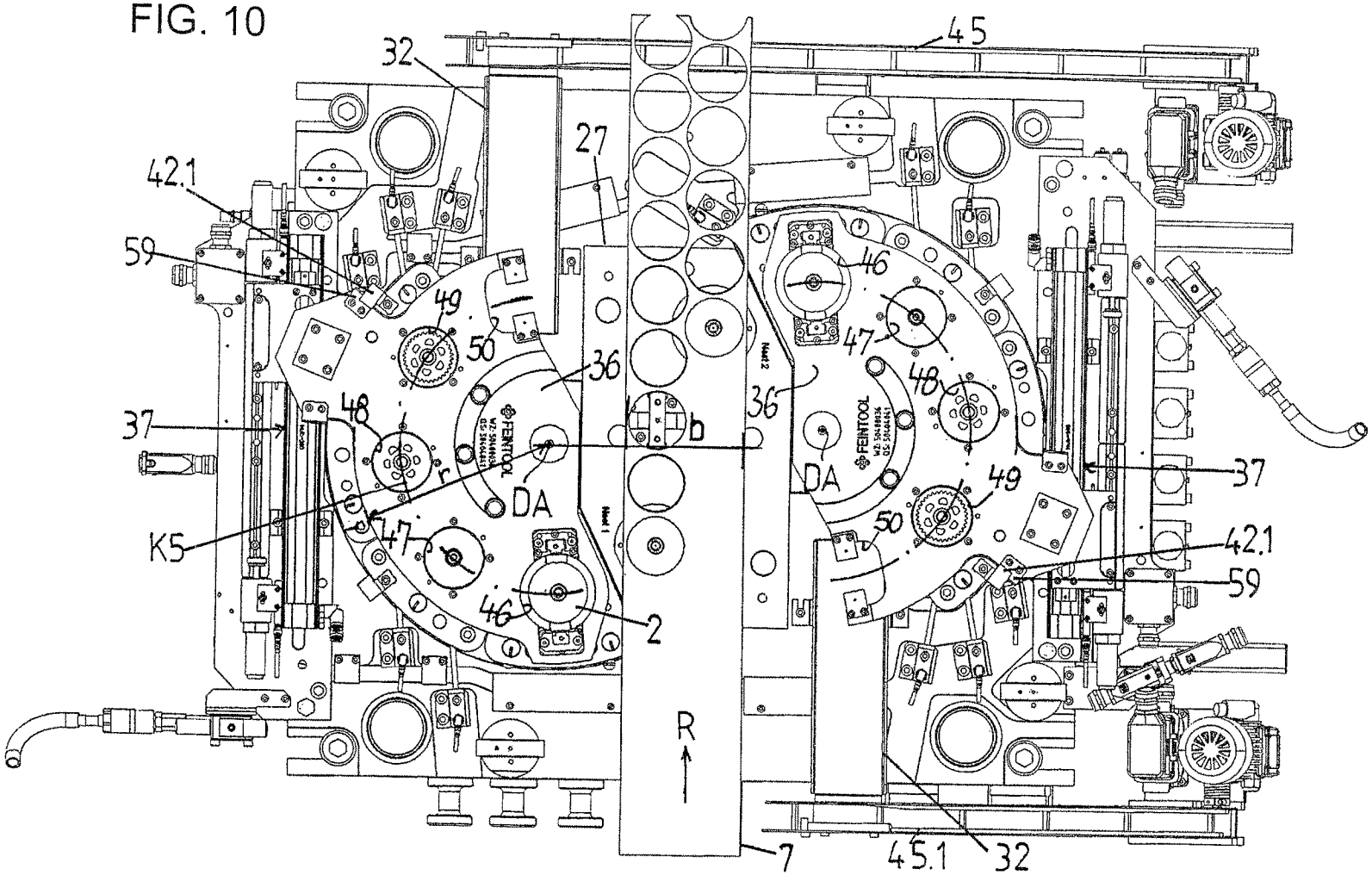
FIG. 10 is a direct view of the lower part with the rotary slides pivoted back in the closed state of the tool with the flat strip.

The rotating axis DA is a distance b away from the far side edge SR of the flat strip 7, the distance being equal to the radius r of the slide plate 36 (see FIG. 10). The rotary slide 37 is attached to the top side OS of the lower block 6 directly at the end face S. This slide comprises a linear drive 39 with a guide rail 40 and carriage 41 for executing a reversible pivoting motion of the slide plate 36 about the rotating axis DA in circular path K1/K2 and K3/K4 by an amount equal to the arc distance BA between the cutting stage 8 and 8.1 and the first processing stage 9 and 9.1 following the cutting stage 8 and 8.1. Here, the guide rail 40 is disposed in such a way that it runs tangentially along the exterior periphery of the lower frames 34 which is coaxial to the circular path K3/K4.

Stops 42.1 and 42.2 are associated with the carriage 41 that runs along the guide rail 40 and are attached at the exterior periphery of the lower frames 34 at a distance which allows the path of displacement of the carriage 41 on the guide rail 40 to be limited to the arc distance BA. To accomplish this, the slide plate 36 is provided with corresponding stop plates 59 which are associated with the stops 42.1 and 42.2.

The lower part of the discharge stage 13 and 13.1 includes the chute 32, which is attached at the lower block 6. The chute slopes downward from the chute entrance 43, which lies in the circular path K3/K4, to a conveyor belt 45 and 45.1 running along the longitudinal sides 44 of the lower part 4 for taking away the finished work pieces.

Figure 8:
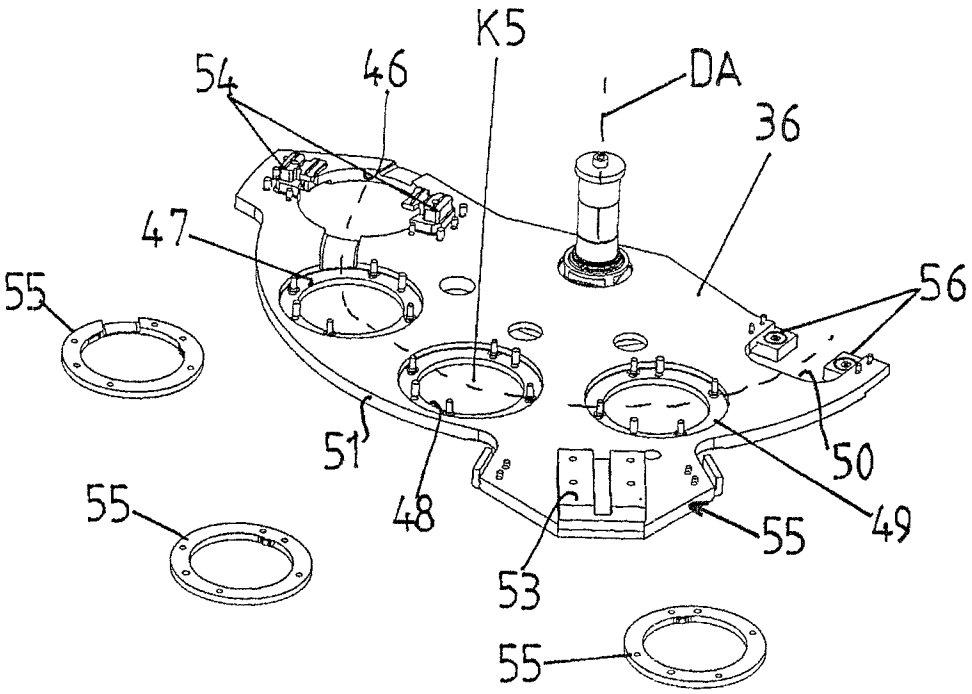
FIG. 8 is a perspective view of the slide plate as seen from the bottom side with claws and transport masks.

FIG. 8 shows a perspective view of the slide plate 36, designed as a section of a circular disk, which is able to pivot about the rotating axis DA and thereby about the center points P1/P2 and P3/P4 of the upper and lower circular paths K1/K2 and K3/K4. The slide plate 36 is provided with transfer openings 46, 47, 48 and 49 and a discharge opening 50. The transfer openings 46 to 49 and the discharge opening 50 lie in a circular path K5 that coincides with circular paths K1/K2 and K4/K5. The K4/K5 distance between the openings is equal to the arc distance BA of the center point separations of the upper and lower active elements 23 and 35 of processing stages 9 to 12 and 9.1 to 12.1 on the circular paths.

The slide plate 36 has a protrusion 55 at the exterior periphery 51 thereof for attaching a dog 53 connected to the carriage 41 of the linear drive 39. The dog executes a reversible pivoting motion between stops 42.1 and 42.2 about the rotating axis DA.

Claws 54 placed in the transfer opening 46 can seize the blank 2 cut in cutting stages 8 and 8.1 as soon as the transfer opening 46 arrives over cutting stage 8 and 8.1 by way of the pivot motion about the rotating axis DA. The transfer openings 47 to 49 are provided with transport masks 55 that enable the blanks 2 to be exactly fixed and aligned relative to the respective processing stage. The discharge opening 50 comprises transport magnets 56 that fix the finished work piece 58 and position it for discharge by way of the chute entrance 43.

The method according to the invention is explained below with the aid of FIG. 7, 9 through 11.

FIG. 7 shows the position of the flat strip 7 on the upper block 5. When the lower part 4 is lowered to open the tool 1, the flat strip 7 is held by the strip holders 26 located on the guide plate 18 and the strip guides 24 attached to the upper block 5 in such a way that a sufficient amount of free space exists above cutting stages 8 and 8.1.

Figure 9:
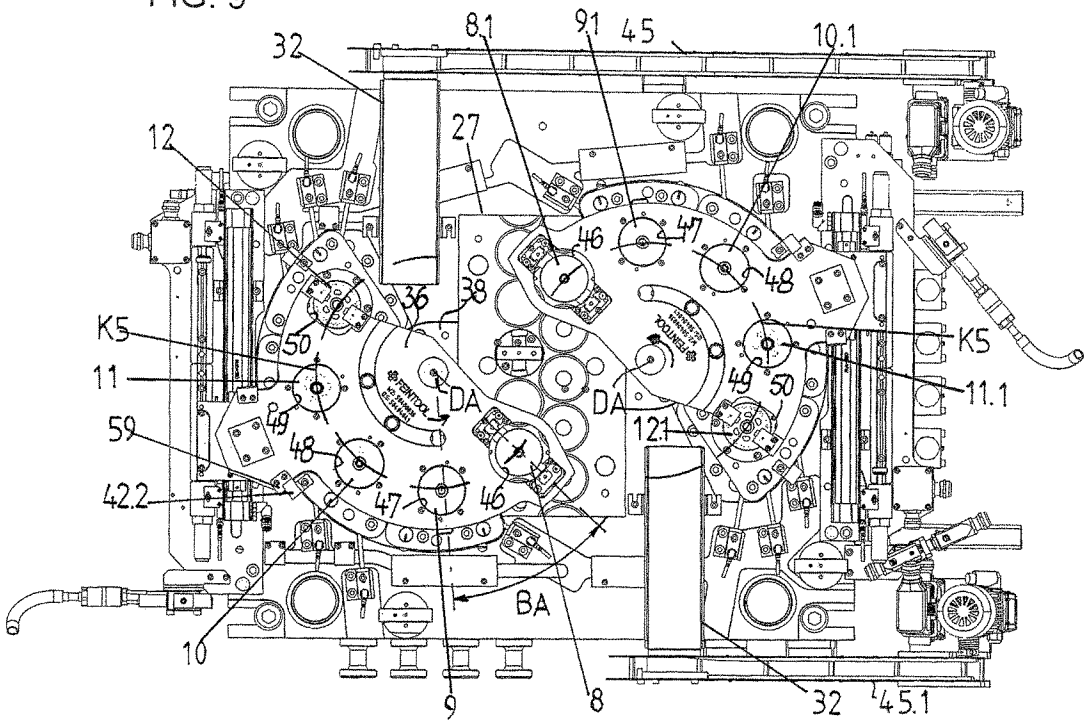
FIG. 9 is a direct view of the lower part with rotary slides pivoted underneath the belt strip in the open state of the tool without flat strip.

The slide plates 36 have made a horizontal pivot motion—as shown in FIG. 9—under the flat strip 7 about rotating axis DA in the direction of the arrows in circular path K5 in arc distance BA in a plane that lies directly above the active elements. Thus, the first transfer opening 46 facing the cutting stage 8 and 8.1 comes to lie above the active elements of the cutting stage 8 and 8.1. At the same time, the transfer openings 47 to 49 have moved over the corresponding active element of the processing stages, and the discharge opening 50 has moved over the corresponding active elements of the processing stages 9 to 11 and 9.1 to 11, and the discharge opening 50 has reached processing stage 12. The protrusion 52 of slide plate 36 is then located at stop 42.2, which is positioned at the outer periphery of the lower frames 34.

In simultaneous fashion, the blank 2 cut in cutting stage 8 and 8.1, the processed blanks 2 in the other processing stages 9 to 11 and 9.1 to 11.1, and the finished work piece 57 are ejected to transfer openings 46 to 49, and the finished work piece 58 is ejected to discharge opening 50.

Slide plate 36 pivots back in a direction opposite to the first pivot motion by the arc distance BA in circular path K5 together with seized blanks 2 and the finished work piece 57. The slide plate 36 releases the cutting stage 8 and 8.1. Transfer openings 46 to 49 with blanks 2 reach processing stages 9 to 12. The blanks are placed in the correct position in processing stages 9 to 12 and 9.1 to 12.1 using the claws 54 and transport masks 55 located in the transfer openings 46 to 49. The finished work piece 57 was transported simultaneous to this through the discharge opening 50 by way of the transport magnets 56 to the chute entrance 43 of the discharge stage 13 and 13.1.

FIGS. 10 and 11 show the position of the transport strip 7 and slide plates 36 in a direct view and in a perspective view of the lower part 4 when the tool 1 is in the closed state. In this state, the flat strip 7 is clamped between the guide plate 18 of the upper part 3 and the cutting plate 27 of the lower part 5, and the cutting process can proceed in cutting stage 8 and 8.1. At the same time as the clamping of the flat strip 7 in cutting stage 8 and 8.1, the slide plate 36 is also clamped between the lower frames 34 and the upper frames 22. The transfer openings 46 to 49 and the discharge opening 50 have assumed a position such that the upper and lower active elements 23 and 35 can process the blanks 2 through the openings 46 to 50, and the finished work piece 57 can be separated from the transport magnets 56 by way of the ejector 58. At the same time, the cutting process in cutting stage 8 and 8.1 begins again, and the transfer process described above continues as described after the tool 1 is opened.

The flat strip 7 is guided over the center of the tool 1 in such a way that the respective far side edges SR of the flat strip 7 facing away from the slide plate 36 are guided over the periphery 51 of the slide plate 36 so that a rotary slide 37 can be used to transfer cut and processed blanks 2 and finished work pieces 57 on each side of the flat strip 7, the pivoting directions of the slides being opposite directions to one another. The rotary slides 37 are offset in the direction BD of travel R of the strip by about four times the arc distance BA such that a sufficient cycle time is available for each processing cycle.

What is claimed is:

1. A device for transferring work pieces into and out of a multi-staged cutting and processing tool, comprising:

an upper part having a cutting stage with at least one cutting punch, a guide plate and pressure plate;

a lower part having at least one cutting plate and pressure plate for cutting out a blank from a flat strip; and a plurality of processing stages lying in a circular path and comprising active elements of the upper and lower parts, the active elements of the upper part comprising at least one selected from the group consisting of the at least one cutting punch and frames of the upper part, the active elements of the lower part comprising at least one selected from the group consisting of the at least one cutting plate, an embossing anvil, the at least one pressure plate and frames for a processing cycle involving processes comprising at least one selected from the group consisting of hole punching, embossing, pre-shaping, drawing, and tooth-cutting; and wherein the flat strip is configured to be clamped in between the cutting plate and the guide plate when the upper and lower parts are closed and can be moved in a direction of travel of the strip when the upper and lower parts are in an open position, and wherein blanks are configured to be moved cyclically from stage to stage by way of a slide, the slide being designed as a rotary slide comprising a plurality of transfer openings and a discharge opening, and the cutting stage and individual processing stages of said multi-staged cutting and processing tool being designed with a discharge stage as separate mutually-supporting components arranged about a rotating axis of the rotary slide supported at a lower block of the lower part, and wherein the transfer openings and the discharge opening lie in a circular path that coincides with circular paths of the active elements of the cutting stage and the processing stages and active elements of the discharge stage, the transfer openings having a distance from one another that is identical to a distance between the active elements in the circular paths.

2. The device according to claim 1, wherein the rotary slide comprises a slide plate in which the transfer openings and the discharge opening are provided for accommodating the blanks, the openings being matched to the active elements of the cutting and processing stages and the discharge stage, wherein the slide plate is connected to a linear drive, which is disposed approximately tangential to the pressure plate and the frames coaxial to the circular path for executing a pivoting motion about a rotating axis fixed at the lower block of the lower part, in such a way that the transfer openings in the circular path and the discharge opening of the slide plate can seize the blanks after said plate is pivoted on the circular path in the direction of the cutting stage by an amount equal to an arc distance of the cutting and processing stages, and said openings can drop the blanks into subsequent processing stages of said multi-staged cutting and processing tool after the slide plate pivots back from the cutting stage.

3. The device according to claim 2, wherein the slide plate is configured to be clamped between the frames of the active elements of the processing stages of the upper and lower parts upon closing in such a way that the active elements can process the blanks through the transfer openings.

4. The device according to claim 2, wherein the rotating axis is a distance away from a far side edge of the flat strip facing away from the slide plate, said distance being the same as a radius of a pusher plate.

5. The device according to claim 2, wherein the slide plate is disposed in a plane that allows horizontal pivoting of the slide plate and transfer openings and discharge opening thereof directly over the respective active elements of the cutting stage and processing stages when the cutting and processing tool is opened.

6. The device according to claim 2, wherein the slide plate is designed as a section of a circular disc provided with a dog at a periphery thereof facing the linear drive, the dog being connected to a carriage guided in a guide rail of the linear drive for purposes of executing the pivot motion of the slide plate about the rotating axis.

7. The device according to claim 2, wherein the slide plate comprises stop plates with associated stops at an outer periphery of the frames of the lower active elements of the lower part for limiting a displacement of a carriage to an arc distance between a fine blanking stage and the processing stages.

8. The device according to claim 2, wherein the transfer opening for the cutting stage is provided with claws for gripping the cut blank, the transfer openings for the processing stages are provided with transport masks for aligning and fixing the blanks, and the discharge opening for discharging a finished work piece is provided with transport magnets for lifting and feeding to a chute.

9. The device according to claim 8, wherein the chute is disposed perpendicular to the circular path and parallel to the direction of travel of the flat strip for the purposes of removing finished work pieces, wherein the chute is connected to at least one conveyor belt for removing the finished work pieces, a direction of removal of the conveyor belt being perpendicular to the chute.

10. The device according to claim 1, wherein two opposite mirror-imaged rotary slides are provided in the direction of travel of the flat strip opposite one another, the slides having pivot directions opposite to one another for transferring the blanks and work pieces, wherein the two rotary slides are disposed offset relative to one another in the direction of travel of the flat strip at a distance that is equal to four times an arc distance of the cutting stage and a first of the processing stages.

11. The device according to claim 1, wherein the discharge stage comprises an ejector fixed to an upper block of the upper part and located in the circular path, the ejector separating a finished work piece from transport magnets of the discharge opening for purposes of discharge to a chute.

12. A method for transferring work pieces in a a multi-staged cutting and processing tool, in which blanks are cut out of a clamped flat strip in an upper part, which includes a cutting stage made up of at least one cutting punch, a guide plate and pressure plate, and a lower part, which includes at least one cutting plate and a pressure plate, the blanks being subjected to at least one selected from the group consisting of hole punching, embossing, pre-shaping, drawing, and tooth-cutting in succession in a plurality of processing stages lying in a circular path and including active elements of the upper and lower parts, the active elements of the upper part comprising at least one selected from the group consisting of the at least one cutting punch such as punches and frames of the upper part, and the active elements of the lower part comprising at least one selected from the group consisting of the at least one cutting plate, an ejector, an embossing anvil, the at least one pressure plate and frames, the method comprising:

moving the blanks by a rotary slide; and moving the flat strip cyclically in a direction of travel of the flat strip, when the upper and lower parts are open, wherein the blanks are transferred between the cutting stage and the processing stages when the tool is open by way of a reversible slide plate of the rotary slide, the reversible slide plate comprising transfer openings and a discharge opening, the rotary slide seizing the cut blanks by making first pivot motions by an amount equal to an arc distance between the cutting stage and the processing stages and bringing the cut blanks to a first processing stage for processing in second motions that are opposite to the first pivot motions and of identical arc distance, wherein at the same time the blanks from the first processing stage and other processing stages are shifted to subsequent respective processing stages, and respective and the finished work pieces are discharged.

13. The method according to claim 12, further comprising in sequence the steps:

holding the flat strip on the guide plate of the upper part when opening the tool, which is done by lowering the lower part;

pivoting the slide plate and the transfer openings and discharge opening thereof that lie in the circular path in a first direction until a first of the transfer openings facing the cutting stage sits over the cutting stage, and remaining transfer openings sit over the processing stages, and the discharge opening sits over a last processing stage, ejecting the blanks from the cutting stage and the processing stages to respective of the transfer openings and ejecting respective of the finished work pieces to the discharge opening, pivoting the slide plate in a direction opposite to the first direction with the blanks seized by the transfer openings until the slide plate releases the cutting stage, and the transfer openings with the blanks reach subsequent processing stages, aligning and centering the blanks in the processing stages, and accommodating the respective finished work pieces in an outlet opening, and clamping the slide plate between the frames of the active elements of the processing stages of the upper and lower parts simultaneously with the clamping of the strip material in the cutting stage when closing the upper and lower parts in the position reached according to said aligning and centering, so that the active elements of the processing stages can process the blanks through the transfer openings, respective new blanks are cut in the cutting stage, and respective of the finished work pieces are pushed out of the discharge opening by an ejector into a chute.

14. The method according to claim 12, wherein the rotary slide is driven by a linear drive attached at the lower block of the lower part and that runs tangentially coaxial to the circular path, the displacement path of said linear drive matching the arc distance between the cutting stage and the processing stages in the circular path.

15. The method according to claim 12, further providing a second rotary slide, wherein each of the rotary slides is used on a respective side of the flat strip to transfer cut and processed blanks, wherein the pivot directions of the rotary slides are opposite to one another.

16. The method according to claim 12, wherein respective far side edges of the flat strip facing away from the rotary slide are guided over a periphery of the slide plate of the rotary slide.

* * * * *